United States Patent [19]

Miquelot

[11] Patent Number: 4,718,200

[45] Date of Patent: Jan. 12, 1988

[54] SHARPENING SHEATH COMBINED WITH A KNIFE

[75] Inventor: Gilles Miquelot, Rumilly, France

[73] Assignee: SEB S.A., Selongey, France

[21] Appl. No.: 821,909

[22] Filed: Jan. 23, 1986

[30] Foreign Application Priority Data

Jan. 30, 1985 [FR] France ..... 85 01293

[51] Int. Cl.[4] ..... B24B 3/54

[52] U.S. Cl. ..... 51/214; 51/211 R; 51/354; 30/138; 76/82

[58] Field of Search ..... 30/138; 51/211 R, 214, 51/354; 76/82, 86

[56] References Cited

U.S. PATENT DOCUMENTS

| | | | |
|---|---|---|---|
| 2,885,836 | 5/1959 | Robitaille . | |
| 2,893,178 | 7/1959 | O'Riordan | 51/214 |
| 4,091,691 | 5/1978 | Bayly | 30/138 X |
| 4,494,339 | 1/1985 | Pittaway | 30/138 X |

FOREIGN PATENT DOCUMENTS

| | | | |
|---|---|---|---|
| 0110661 | 6/1984 | European Pat. Off. . | |
| 644875 | 4/1937 | Fed. Rep. of Germany | 51/214 |
| 2223139 | 10/1974 | France . | |
| 2321372 | 3/1977 | France . | |
| 2333614 | 7/1977 | France . | |
| 56-24542 | 3/1971 | Japan . | |
| 48-40843 | 11/1973 | Japan . | |
| 50-13520 | 5/1975 | Japan . | |

*Primary Examiner*—E. R. Kazenske
*Assistant Examiner*—Michael D. Folkerts
*Attorney, Agent, or Firm*—Young & Thompson

[57] ABSTRACT

A blade-sharpening sheath contains sharpening elements (31) resiliently mounted in a crossed arrangement so as to define between them a blade-sharpening cavity which extends above a line (P) of intersection of the sharpening profiles (34). The rest position of the sharpening elements (31) is defined by abutment shoulders (42c) in cooperating relation with the sharpening profiles beneath the line (P). The abutment shoulders (42c) are carried by ribs (42) and the inner edge (42b) of each rib serves to guide the knife blade (48). The distance (h) between the tip (52) and the back (49) of the blade is slightly shorter than the distance (H) between the line (P) and the bottom of a groove (43) for guiding the back of the blade. The cutting edge (51) of the knife blade is inclined with respect to the back (49) of the blade.

11 Claims, 13 Drawing Figures

SHARPENING SHEATH COMBINED WITH A KNIFE

BACKGROUND OF THE INVENTION

1. Field of the Invention

The present invention relates to a sharpening sheath for a knife or the like.

The invention is also concerned with the combination of a sheath of this type with a knife.

2. Description of the Prior Art

A known blade-sharpening sheath disclosed in French patent No. FR-A-2 223 139 comprises a body in which is defined a passageway for receiving a cutting-blade, an access opening at one end of said passageway, and a sharpening device attached to the body in the vicinity of the access opening. The sharpening device comprises two blade-sharpening elements disposed in a relatively crossed arrangement in order to define a blade-sharpening cavity between said elements. Resilient means have the function of supporting the blade-sharpening elements in such a manner as to permit an increase both in width and depth of the blade-sharpening cavity as well as restoring the blade-sharpening elements to a rest position in which the sharpening cavity has a minimum width and a minimum depth.

When the knife is stored within the sheath or when the knife is withdrawn from the sheath, the cutting edge of the knife-blade slides against the bottom portion of the blade-sharpening cavity which is located at the point of intersection of the blade-sharpening profiles when looking at these latter in the direction of movements of introduction and withdrawal. During these movements, the blade-sharpening elements undergo a relative displacement, thus producing a variation in depth of the blade-sharpening cavity and a correlative displacement of the point of intersection of the profiles along each profile. Thus the profiles develop uniform wear and have a considerably longer service life.

When the appliance is new, the depth of the blade-sharpening cavity in the state of rest permits entry of the blade tip therein when this latter is introduced through the access opening. Should this not be the case, the blade tip would come into abutting contact with the blade-sharpening elements and it would prove impossible to engage the blade within the sheath. However, the result achieved by progressive wear of the profiles is that, in the state of rest, the blade-sharpening cavity increases in depth throughout the lifetime of the appliance. Thus an appliance in which the blade-sharpening elements are worn no longer sharpens the tip region of the knife blade.

SUMMARY OF THE INVENTION

The aim of the invention is thus to propose a blade-sharpening sheath such that the sharpening range is no longer affected by wear of the sharpening elements.

The invention is thus directed to a blade-sharpening sheath comprising a body in which is defined a passageway for receiving a knife blade, an access opening at one end of said passageway, and a sharpening device attached to the body in the vicinity of the access opening. The sharpening device comprises at least two blade-sharpening elements in relatively displaced relation in the longitudinal direction of the passageway and having crossed blade-sharpening profiles between which is defined a blade-sharpening cavity and a region of relative overlapping of said sharpening elements.

Resilient means have the function of urging the blade-sharpening elements to a rest position in a direction which tends to close the blade-sharpening cavity while increasing the extent of overlap of said sharpening elements.

In accordance with the invention, said blade-sharpening sheath is distinguished by the fact that the resilient means are prestressed in the rest position and that the body is adapted to carry internal abutment means which, in the rest position of the blade-sharpening elements, cooperate with the sharpening profile of said elements in their region of relative overlap outside a path provided for the knife blade.

Thus the rest position of the blade-sharpening elements is no longer defined by the expanded state of the resilient elements but by abutment members attached to the body of the sheath. Furthermore, said abutment members are adapted to cooperate with the sharpening profile of the blade-sharpening elements, with the result that the positions of the sharpening profiles with respect to each other is independent of their state of wear. Since the blade-sharpening cavity consists of a space which is left free between the sharpening profiles, said cavity always has the same size in the state of rest. Since the abutment means and the blade-sharpening elements in the state of rest are in contact with each other in the region of overlap of the sharpening elements and more particularly outside a path provided for the cutting-blade, displacement of the blade within the sheath is not hindered in any respect. On the contrary, in a preferred embodiment the abutment means comprise two abutment shoulders each adapted to cooperate with one of the blade-sharpening elements and relatively spaced at a suitable distance in the longitudinal direction of the passageway so as to permit displacement of the cutting-blade and to ensure accurate lateral guiding of said blade.

It is acknowledged that U.S. Pat. No. 2,885,836 discloses a sharpening tool in which the sharpening elements are urged against stops by resilient means in the rest position. However, these stops do not cooperate with the sharpening profile of the sharpening elements, with the result that the effects of the invention are not obtained. Moreover, said sharpening tool is not mounted within a sheath, with the result that the knife does not have a well-defined path. It would consequently be of little use to ensure that the bottom of the sharpening cavity has a fixed position which is independent in particular of the degree of wear of the sharpening profiles.

According to another aspect of the invention, the combination of the blade-sharpening sheath aforesaid with a knife provided with a handle and a blade having a cutting edge and a back located opposite to said cutting edge is distinguished by the fact that the sheath is provided with an internal supporting slide-surface for the back of the blade, that at least a portion of the back of the blade is substantially rectilinear and adapted to slide on said supporting slide-surface, and that the distance between a tip of the blade and the extension of the rectilinear portion of the back is equal to or slightly shorter than the distance between the supporting slide-surface and the bottom of the sharpening cavity when the blade-sharpening elements are in the rest position.

The user introduces the knife so that the back of the blade slides against the supporting slide-surface. In this position, the tip of the blade approaches the sharpening cavity in the vicinity of the point of intersection of the blade-sharpening profiles. The cutting edge of the blade therefore immediately encounters the blade-sharpening profiles. In the assembly thus formed, the knife will be sharpened over its entire length at each introduction and withdrawal throughout the service life of the appliance.

BRIEF DESCRIPTION OF THE DRAWINGS

Other features of the invention will be more apparent to those skilled in the art upon consideration of the following description and accompanying drawings, wherein.

DESCRIPTION OF THE PREFERRED EMBODIMENTS

Figure 1:
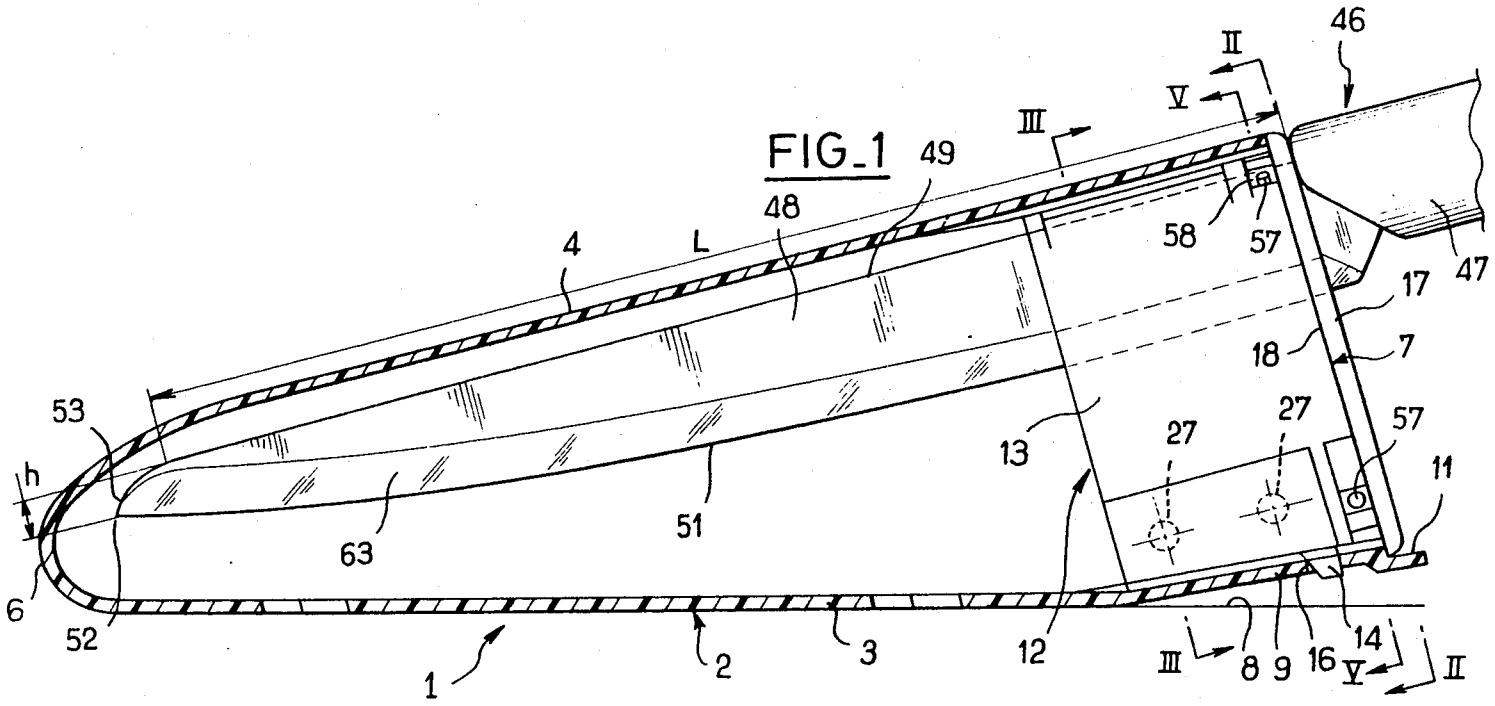
FIG. 1 is a side view in elevation showing a knife in accordance with the invention and engaged in a sheath in accordance with the invention, an outer jacket of said sheath being shown in longitudinal section and the handle of the knife being partly broken away.

The assembly shown in FIG. 1 comprises a sheath 1 which is in turn formed by an outer jacket 2 of semi-rigid plastic. The bottom face 3 of the jacket is flat in order to constitute a sole and the top face 4 of said jacket is inclined in order to ensure that the jacket 2 is narrower at a closed rear end 6 than at an open front end 7. In the vicinity of the front end 7, the sole 3 is elbowed in order to slant upwards from a sole-bearing plane 8 (such as a table, for example). There are formed in this elbowed region of the sole 3 two longitudinal slits (not shown in the drawings) between which is defined a resilient leaf 9 terminating in a tongue 11 which can be depressed by the user in order to move the resilient leaf 9 towards the plane 8 by elastic deformation substantially at the level of the elbow between the leaf 9 and the sole 3 proper.

Within the opening 7 of the jacket 2 is removably mounted a blade-sharpening cartridge 12 which extends substantially to the elbow between the sole 3 and the leaf 9. In order to permit detachable assembly, the plastic casing 13 of the cartridge 12 is provided on its underface with a lug 14 engaged in a slot 16 of the resilient leaf 9 in the vicinity of the tongue 11. The casing 13 has a front wall 17 provided around its entire periphery with a shouldered edge 18 which is applied against the open end 7 of the jacket 2 when the lug 14 is engaged within the slot 16.

The jacket 2 and the casing 13 form the body of the sheath of the particular type contemplated by the invention.

As shown in FIGS. 2 to 5, the casing 13 of the cartridge 12 is constituted by two half-shells 13*a* and 13*b* assembled together along a longitudinal mid-plane 19 which is also the longitudinal mid-plane of the jacket 2 when the cartridge is mounted therein. The two half-shells 13*a* and 13*b* are assembled together by snap-action engagement. More precisely (as shown in FIG. 4*a*), the half-shell 13*a* has two slotted projections 21 which extend beyond the plane 19 and in which are engaged bosses 22 formed on the top face of the half-shell 13*b* in the vicinity of the plane 19. The half-shells 13*a* and 13*b* have walls 23 between which is defined a substantially parallelepipedal internal space 24. At the lower ends thereof, the walls 23 form two adjacent longitudinal lips 26 located respectively on each side of the plane 19. The lip 26 of the half-shell 13*b* is adapted to carry two studs 27 which project beyond the plane 19 and are split along their axes in order to be compressible in the radial direction, each stud being engaged in an orifice 28 of the other lip 26. The split studs 27 terminate in a bulge 29 for locking said studs in the interengaged position.

Figures 6, 7:
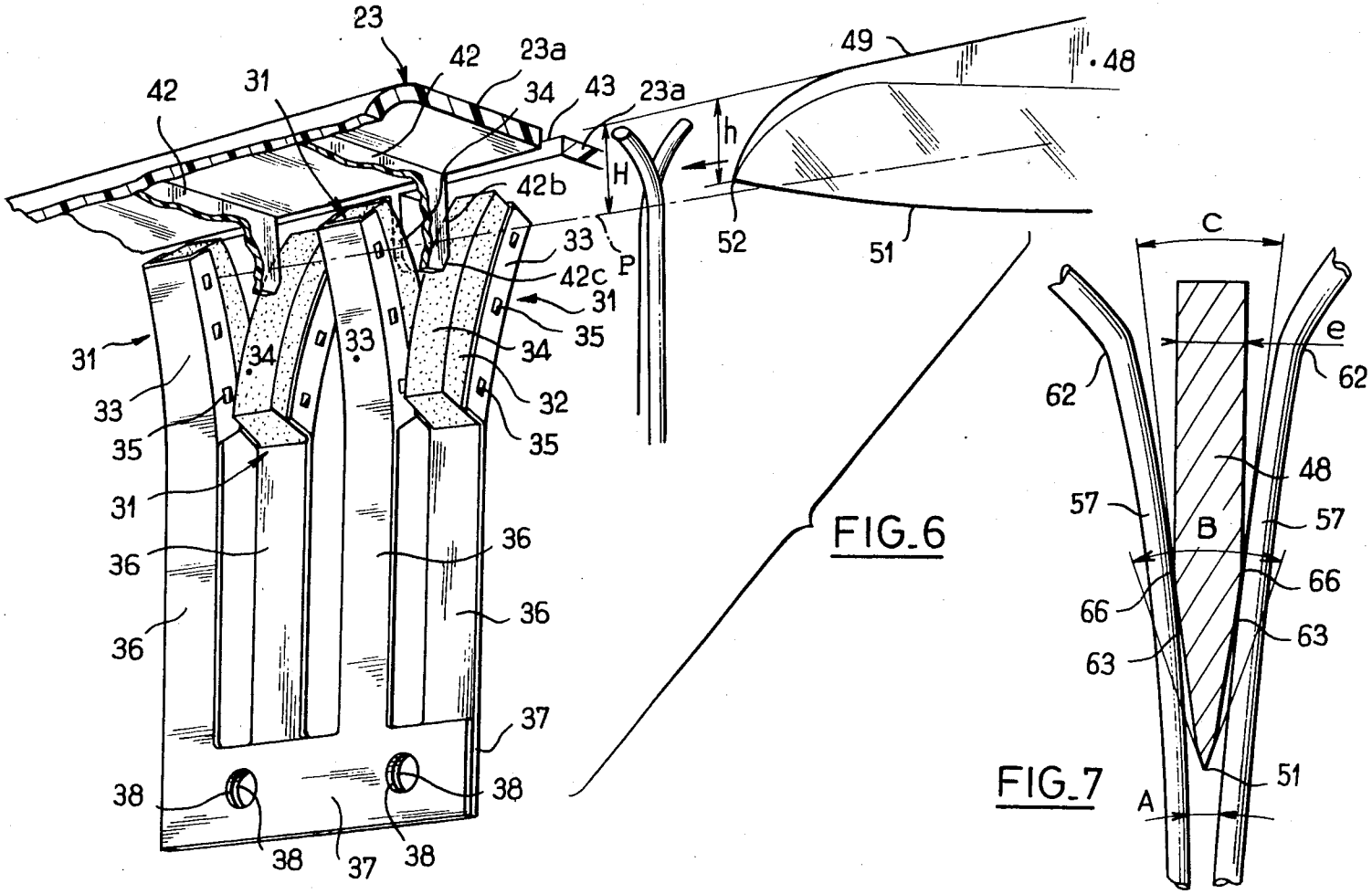
FIG. 6 is a fragmentary sectional view in perspective illustrating certain dimensional and spatial relations within the blade-sharpening sheath and between this latter and the knife blade.
FIG. 7 is a partial transverse sectional view to a larger scale showing the mask in which the knife blade is engaged.

Within the internal space 24 are mounted four blade-sharpening elements 31 each comprising an abrasive block 32 (as shown in FIG. 6), the rear region of which is clamped in a metallic U-section holder 33 by means of inwardly projecting strips 35 formed by punching in the side walls of said holders. The blade-sharpening elements 31 are arranged in succession in a longitudinal direction of the sheath 1. In addition, each abrasive block 32 has a blade-sharpening profile 34 facing away from its holder 31. Looking in the longitudinal direction of the sheath 1, said profile 34 is in a crossed position with respect to the blade-sharpening profile(s) of the adjacent abrasive block(s) 32. The successive blade-sharpening profiles 34 are directed alternately to one side and then to the other when they are observed in the longitudinal direction of the sheath. The successive holders 31 are inclined alternately on each side of the longitudinal mid-plane 19. Between its two side walls, each holder has a bottow wall connected to an extenson in the form of an elastically flexible strip 36. In a rest position of the sharpening elements 31, each flexible strip 36 extends substantially in the plane P to a bottom end-portion 37 which also supports the other blade-sharpening element 31, the profile 34 of which faces in the same direction. Each bottom end-portion 37 is integral with the two flexible strips 36 and the two holders 33 carried by said bottom end-portion, the unit thus formed being fabricated by cutting-out from sheet metal. Furthermore, the two units thus required for supporting the four abrasive blocks 32 are identical but reversed by 180° with respect to each other. The bottom end-portions 37 of said units are placed one against the other and their flexible strips 36 are placed side by side. Each bottom end-portion 37 has two bores 38 which are located in the line of extension of the two bores 38 of the other bottom end-portion 37.

Figure 3:
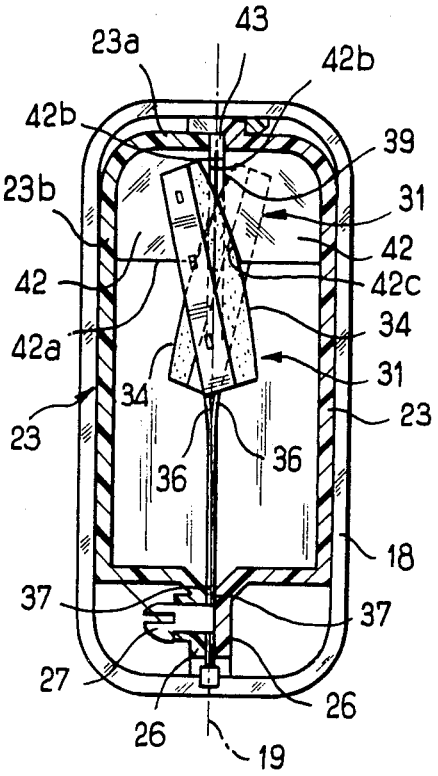
FIG. 3 is a sectional view of the sheath, this view being taken along the plane III—III of FIG. 1 when the knife-sharpening elements are in the rest position.
Figure 12:
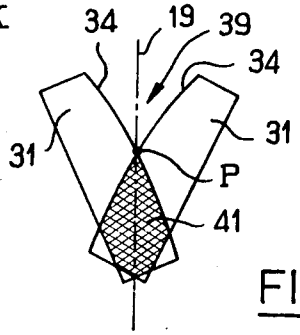
FIG. 12 is a schematic view showing the blade-sharpening elements in the relatively crossed position.

It is apparent from FIG. 3 that, under service conditions, the bottom end-portions 37 are clamped between the two lips 26 of the half-shells 13*a* and 13*b* and each resilient stud 27 is engaged within two aligned bores 38. The flexible strips 36 occupy substantially the lower half of the height of the internal space 24 and the blade-sharpening elements 31 occupy the upper half of said height. At the point of junction between each flexible strip 36 and the holder 31 carried by this latter, the sheet metal member which constitutes these two elements is cambered in such a manner as to ensure that the blade-sharpening profiles 34 are directed obliquely upwards. Thus, by reason of their crossed arrangement, the blade-sharpening profiles observed in the longitudinal direction of the sheath (as shown in FIG. 12) define between them a blade-sharpening cavity 39 having a substantially V-shaped cross-section located above their point of intersection P and a region 41 in which the blade-sharpening elements overlap each other below their point of intersection P.

The blade-sharpening elements 31 are shown in FIG. 3 in their rest position in which the sharpening cavity 39 has its minimum dimension and the overlap region 41 has its maximum dimension. The blade-sharpening elements 31 are continuously restored to this position by the elastic deformation of the flexible strips 36 which carry said elements.

Figure 4:
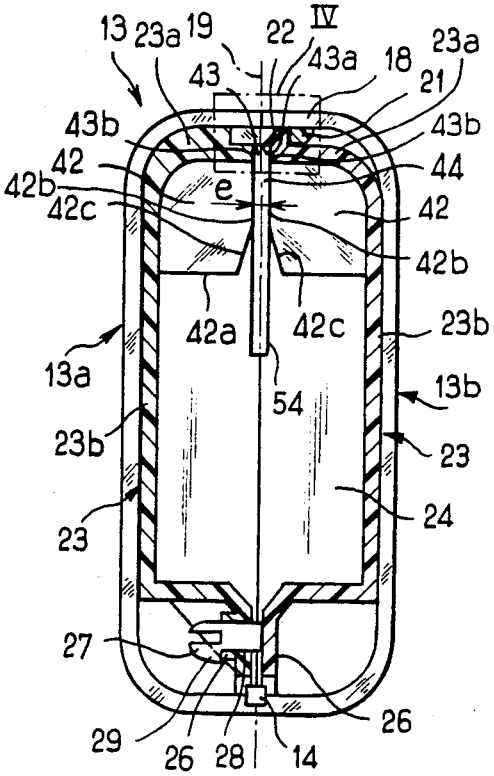
FIG. 4 is a view which is similar to FIG. 3 but shows the casing of the blade-sharpening cartridge alone.
Figure 4A:
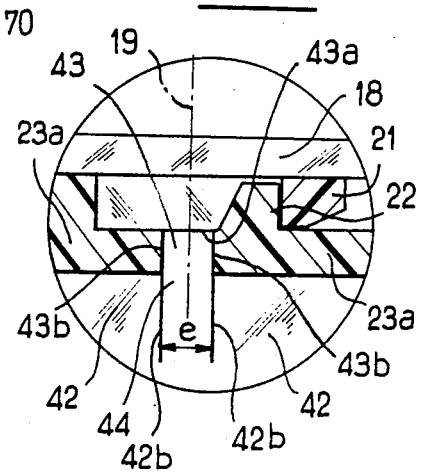
FIG. 4*a* is an enlarged view showing the detail IV of FIG. 4.

In accordance with the invention, the cartridge casing 13 comprises abutment means 42 which are adapted to cooperate with the blade-sharpening profiles 34 in order to define the rest position of the sharpening elements 31. In the example shown in the drawings, each half-shell 13*a*, 13*b* has two ribs which are integral with the wall 23 and are transverse to the longitudinal direction of the sheath. Each rib 42 is located opposite to one of the two blade-sharpening profiles 34 which is directed towards the half-shell 13*a* or 13*b* which carries said rib. Each rib 42 is joined to the wall 23 of the supporting half-shell and, more precisely, at its top region 23*a* and at the top of its lateral region 23*b*. Each rib 42 has a bottom edge 42*a* which is substantially perpendicular to the plane 19 and a lateral edge 42*b* which is parallel to said plane 19 and is set back with respect to the plane 19 at a distance e/2 equal to one-half the thickness e of a path 44 provided for the cutting-blade to be sharpened. It can thus be understood that, as shown in FIG. 4 and in particular in FIG. 4a, the cutting-blade will be guided laterally along the path 44 by the four edges 42*b* of the four ribs 42 which are located successively on each side of the plane 19.

The path 44 is further defined by a longitudinal groove 43 which is provided between the top regions 23*a* of the half-shells 13*a* and 13*b*. The end-wall 43*a* of the groove 43 is materialized by the bottom face of the slotted projections 21. The groove 43 has a width e equal to the distance between the edges 42*b* as observed in the longitudinal direction of the sheath. Thus the edges 42*b* of the ribs 42 are located vertically beneath the edges 43*b* of the groove 43.

The edges 42*a* and 42*b* of each rib 42 are joined to each other by means of a chamfered edge 42*c* on which one of the blade-sharpening profiles 34 is intended to bear in order to define its rest position. The angle of slope of the chamfered edges 42*c* with respect to the plane 19 is chosen so as to correspond substantially to the angle of slope, in the rest position, of that region of the profiles 34 which is applied against the chamfered edges.

In the rest position defined by the chamfered edges 42*c*, the blade-sharpening profiles 34 cross each other symmetrically with respect to the plane 19 when looking lengthwise along the sheath.

Since each chamfered edge or abutment 42*c* is located outside the blade path 44, it does not interfere with the displacement of the blade. Each sharpening profile 34 which is intended to cooperate with the cutting-blade on one side of the plane 19 is adapted to cooperate in the rest position with a chamfered edge 42*c* located on the other side of the plane 19 and supported on said chamfered edge by a region located beneath the point P carried by the plane 19 or in other words by a region adjacent to the region 41 of overlap of the blade-sharpening elements 31.

In accordance with another distinctive feature of the invention, in the rest position of the blade-sharpening elements 31, the flexible strips 36 are in a prestressed state in which the abrasive blocks 32 are applied against the ribs 42 with a predetermined force. Thus, as the degree of wear of the abrasive blocks 32 increases, so the flexible strips 36 produce action by means of their residual range of elastic travel in order to ensure that the blade-sharpening profiles 34 are always restored to their well-determined rest position against the chamfered edges 42*c*.

Figure 11:
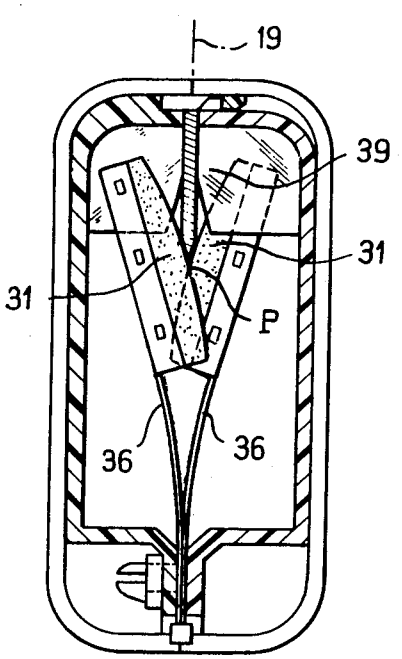
FIG. 11 is a view which is similar to FIG. 10 but shows the knife blade at the end of introduction or at the beginning of withdrawal.

It is apparent from FIG. 11 that, by means of an additional flexural deformation of the strips 36, the blade-sharpening elements 31 can be moved away from each other in order to increase the width and depth of the blade-sharpening cavity 39. The blade-sharpening profiles 34 have a convex curvature which is studied in order to ensure that the angle formed at the point of intersection P at the bottom of the cavity 39 is substantially constant irrespective of the relative spacing of the elements 31.

As shown in FIG. 1, the assembly herein described further comprises a knife 46 having a handle 47 and a cutting-blade 48, one longitudinal edge of which constitutes a back 49 and the opposite edge constitutes a cutting edge 51 which terminates in a tip 52 at the end remote from the handle 47.

Figure 10:
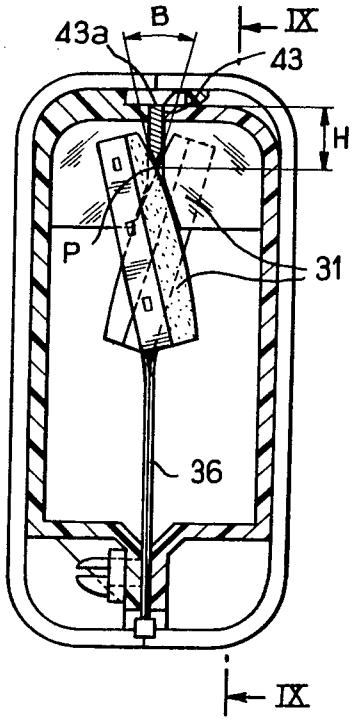
FIG. 10 is a sectional view taken along the plane X—X of FIG. 9, in which the knife blade is in active contact with the sharpening elements in the rest position.

The back 49 of the blade is rectilinear over the greater part of its length along a region designated as L in FIG. 1. In the vicinity of the tip 52, the back of said blade has a sharply curved portion which is joined to the tip by means of an end portion 53 which extends in a direction transverse to the blade and especially to the region L of the back 49. Within the sheath 1, said region L is parallel to the longitudinal direction of the sheath which is in turn parallel to the face 4 of the jacket 2. In accordance with an important feature of the knife-sheath assembly, the distance h (FIG. 1) between the blade tip 52 and the extension of the region L is equal to or slightly shorter than the distance H between the point P when the blade-sharpening elements 31 are in the rest position (as shown in FIG. 10) and the endwall 43*a* of the groove 43. Thus, when the knife 46 is engaged while maintaining its back 49 against the endwall 43*a* of the groove 43, the blade tip 52 of the knife 46 is capable of engaging within the blade-sharpening cavity 39 directly above the point P of intersection of the blade-sharpening profiles 34.

With respect to the back 49 of the knife blade, the cutting edge 51 is inclined over its entire length in a direction which converges towards the blade tip 52. Thus, once the tip 52 has been engaged in the blade-sharpening cavity 39 as stated above, the cutting edge 51 rapidly encounters the point P of intersection of the blade-sharpening profiles 34, then produces a uniform thrust on the blade-sharpening elements 31 which are moved away from each other until the point P (as shown in FIG. 11) is located at a short distance from the lower end of the abrasive blocks 32 when the knife handle 47 is abuttingly applied against the front wall 17 as illustrated in FIG. 1. This ensures that the blade-sharpening profiles work and consequently develop wear over a substantial proportion of their height when the knife is introduced and withdrawn, and work especially in the region in which the profiles are applied against the chamfered edges 42*c* when they are in the rest position.

Figure 2:
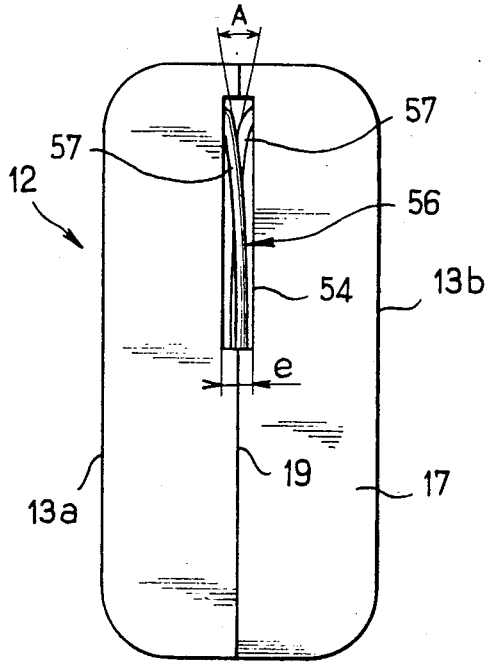
FIG. 2 is a front view of the knife-sharpening cartridge, this view being taken along the plane II—II of FIG. 1.

As shown in FIG. 2, the front wall 17 is made up of two portions which are each formed in one piece with one of the half-shells 13*a* or 13*b*. The two portions of the wall 17 define between each other an opening 54 through which the knife blade 48 is permitted to gain access to its path 44 within the cartridge 12. The opening 54 extends substantially over one-half the height of the wall 17 and has the same width e as the path 44. The upper end of said opening is located in the line of extension of the end-wall 43*a* of the longitudinal groove 43.

In accordance with yet another distinctive feature of the invention, the cartridge 12 further comprises means 56 for partially masking the opening 54 and more particularly for masking the lower region of the opening 54 which is located opposite to the overlap region 41 of the blade-sharpening elements 31 in the rest position.

Figure 5:
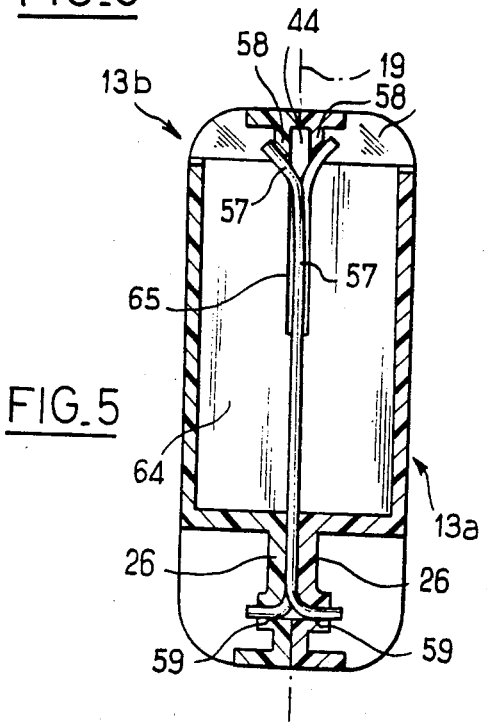
FIG. 5 is a sectional view of the casing of the blade-sharpening cartridge, this view being taken along the plane V—V of FIG. 1.

The masking means 56 comprise two resilient rods 57 of wire which extend one after the other behind the opening 54 in the direction of the height of this latter. As shown in FIG. 6 in which the intersection of the profiles is materialized by the chain-dotted line P, this overlapping relation of the two wire rods 57 is located beneath the point of intersection P, that is to say opposite to the region of overlap of the blade-sharpening profiles 34 in the rest position. Above the point P of intersection considered in the rest position of the blade-sharpening elements, the two rods 57 extend progressively away from each other in order to free the opening 54 in the upper region which is aligned with the blade-sharpening cavity 39. As shown in FIG. 5, the resilient rods 57 are bent away from each other at their upper ends, each rod being thus applied against the outer face of a boss 58 carried by one of the half-shells 13*a*, 13*b* on each side of the path 44. The resilient rods 57 are guided in a plane which is parallel to that of the opening 54. To this end, the upper ends of said rods are guided between the front wall 17 and a fin 70 which is parallel to the wall 17. At the lower ends thereof, the two resilient rods 57 are clamped in position one behind the other between the two lips 26 of the half-shells 13*a* and 13*b* and are bent-back at right angles away from each other, each bent-back end portion being inserted in an anchoring bore 59 formed in one of the lips 26.

Figure 8:
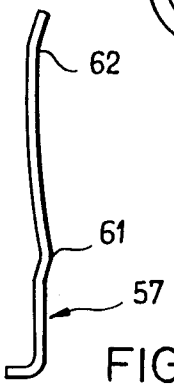
FIG. 8 is a front view of one of the elements of the mask.

As shown in FIG. 8, the lower end of each resilient rod 57 is provided with an inwardly bent portion 61 which is formed in the contrary direction with respect to its outwardly bent upper end. Thus the application of the upper end of each resilient rod 57 against the outer face of the associated boss 58 has the effect of subjecting the rods to bending prestress and producing a degree of curvature which ensures that the upper portion or so-called upper inlet of the opening 54 is freed by said rods. By virtue of this distinctive feature, the bottom of the free upper inlet of said opening can have a very small angle A (as shown in FIG. 2) of smaller value than the angle B at which the blade-sharpening profiles 34 cross each other.

In the example illustrated in the drawings, the cutting-blade 48 has a constant thickness in the vicinity of e (FIG. 7) except in a hollowed-out marginal band 63 extending along the cutting edge 51 on each side of the knife blade 48 in order to provide a symmetrical reduction in thickness from the region of constant thickness to the cutting edge 51 of said blade. The angle C made between the two hollowed-out marginal bands 63 is also larger than the angle A.

As shown in FIG. 5, the cartridge 12 also comprises a rear wall 64 constituted by two half-walls each associated with one of the half-shells 13*a* or 13*b*. An elongated opening 65 is defined between said half-walls and substantially located in the line of extension of the opening 54 which passes through the front wall 17. A passageway is thus formed within the sheath 1 for the knife blade 48. Said passageway comprises the opening 54, the path 44, the opening 65, and finally the hollow interior of the jacket 2.

The operation of the assembly described in the foregoing takes place as follows:

When a knife blade 48 is not present, the blade-sharpening elements 31 take up their rest position. Should it be desired to store the knife 46 in its sheath 1, the blade tip 52 is engaged within the opening 54 and more precisely within the free upper inlet of said opening between the resilient rods 57. In this connection, it is preferable to ensure that said free upper inlet extends at least over the vertical distance or height h (as shown in FIG. 6). Should this not be the case, however, it is nevertheless possible to introduce the blade tip 52 by downwardly inclining the knife handle, then restoring the knife to the horizontal position in order to produce a slight outward displacement of the resilient rods 57. In any case, when the introduction of the knife is continued, the blade 48 of increasing depth separates the resilient rods 57 to a progressively greater extent and the upper ends of said rods move away from their bearing bosses 58 (FIG. 5). As shown in FIG. 7, the conditions explained earlier in regard to the angles A, B and C are such that the knife blade 48 is applied against the resilient rods 57 on the line of junction 66 between the hollowed-out marginal bands 63 and the region having a constant thickness e of the knife blade 48. In contrast, the cutting edge 51 is free from any contact with the resilient rods 57 which would otherwise be liable to damage said edge.

As the knife blade is inserted in the sheath to a greater depth, the blade tip 52 engages within the blade-sharpening cavity 39 as stated earlier. Since the resilient rods 57 tend to assume their minimum elastic stress or in other words their minimum spacing, the back of the knife blade 49 is applied against the end-wall 43*a* of the longitudinal groove 43 and against the top edge of the opening 54, thus effectively ensuring that the blade tip 52 will penetrate into the blade-sharpening cavity 39 but without coming into contact with the first abrasive block 32.

Taking into account the angle of slope of the cutting edge 51 with respect to the back 49 of the knife blade 48, the progressive introduction of the blade 48 into the sharpening cavity 39 has the effect of progressively separating the blade-sharpening elements 31. However, since the angle between the crossed profiles 34 is substantially constant irrespective of the spacing of said profiles, the blade-sharpening conditions are the same along the entire cutting edge 51. So far as the abrasive blocks 32 are concerned, wear of these blocks takes place uniformly along their length and not in a localized manner.

Figure 9:
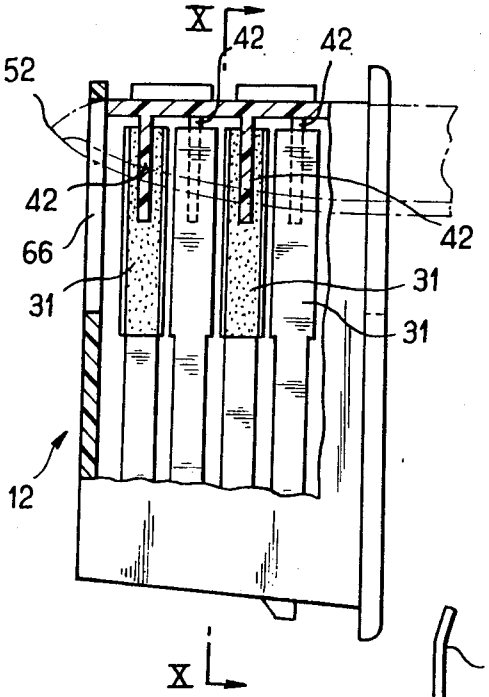
FIG. 9 is a longitudinal part-sectional view of the cartridge along the plane IX—IX of FIG. 10 and shows the manner in which said cartridge cooperates with the knife blade at the beginning of introduction or at the end of withdrawal.

As shown in FIG. 9, a blade tip 52 which has passed through the blade-sharpening cavity emerges from the cartridge 12 through the opening 65 in order to penetrate into the free space within the jacket 2. The end of the blade-insertion travel is defined by abutting contact of the knife handle 47 with the front wall 17 of the cartridge.

At the time of withdrawal of the blade, the blade-sharpening cavity is progressively re-closed until it finally returns to its rest position when the blade tip 52 has been withdrawn from the cavity.

By virtue of the small difference between the heights h and H (FIG. 6), sharpening of the knife blade 51 begins in the immediate vicinity of the blade tip 52. The achievement of this result remains as a permanent distinctive feature throughout the lifetime of the appliance in spite of the inevitable wear of the blade-sharpening profiles 34. The blade-sharpening cavity is in fact defined by profiles 34 and it is in relation to these latter that the rest position of the blade-sharpening elements 31 is defined by means of the chamfered abutment edges 42*c*.

Moreover, the ribs 42 which carry the abutment edges 42*c* ensure very accurate lateral guiding of the knife blade 48, thus preventing any jamming of the blade within the sheath.

As will readily be apparent, the invention is not limited to the examples described with reference to the accompanying drawings and many arrangements may accordingly be contemplated without thereby departing from the scope or the spirit of the invention.

From this it follows that provision need be made for only two blade-sharpening elements. Furthermore, instead of being capable of moving independently of each other as in the example shown, the blade-sharpening elements could have movements which are made symmetrical by means of a mechanical coupling, in which case it would only be necessary to provide a stop in cooperating relation with one of the blade-sharpening elements.

The device for partial masking of the opening 54 could consist of a spring-loaded sliding shutter.

What is claimed is:

1. An elongated knife sheath having an access opening at one end thereof for receiving a knife blade, said sheath including; a blade-sharpening body (2, 13) in which is defined a passageway (54, 44, 65, 2) for receiving said knife blade (48), said access opening (54) being at one end of said passageway, and a sharpening device (31, 36, 37) attached to the body (2, 13) in the vicinity of the access opening (54), the sharpening device comprising at least two blade-sharpening elements (31) in relatively displaced relation in the longitudinal direction of the passageway and having crossed blade-sharpening profiles (34) between which is difined a blade-sharpening cavity (39) and a region (41) of relative overlapping of said sharpening elements (31), and resilient means (36) having the function of urging the blade-sharpening elements (31) to a rest position in a direction which tends to close the blade-sharpening cavity (39), wherein the resilient means (36) are prestressed in the rest position, and abutment means we then said sheath (42*c*) which, in the rest position of the blade-sharpening elements (31), bear against the sharpening profile (34) of said elements in regions spaced from said cavity (39) outside a path (44) provided for the knife blade (48) such that each blade-sharpening element abuts an internal abutment means located on a side of the blade opposite from the side sharpened by the associated blade-sharpening element.

2. A sheath according to claim 1, wherein the blade-sharpening elements (31) are capable of moving independently of each other and wherein the abutment means comprise two abutment shoulders (42*c*) each adapted to cooperate with one of the blade-sharpening elements (31) and having between them, as seen along the longitudinal direction of the passageway, a distance (3) which is suitable for passing the blade (48) of a knife (46).

3. A sheath according to claim 2, wherein the abutment shoulders (42*c*) are extended, in a direction away from said region of relative overlap, by two lateral guides (42*b*) for the knife blade (48).

4. A sheath according to claim 1, wherein the abutment means (42*c*) are carried by at least one rib (42) formed within the body (2, 13) and extending transversely to the direction of introduction of the blade.

5. A sheath according to claim 1, wherein said sheath is provided in the vicinity of the access opening with a mask (57) which substantially shuts-off the access opening (54) opposite to the overlap region (41) of the blade-sharpening elements (31) and wherein said mask is capable of resilient withdrawal by displacement in a plane transverse to the direction of introduction.

6. A sheath according to claim 5, wherein the mask comprises two members (57) adjacent to each other opposite to the overlap region (41) of the blade-sharpening elements (31), said members being capable of progressively opening-out in order to free the access opening (54) at the end opposite to the blade-sharpening cavity (39).

7. A sheath according to claim 6, wherein the two members (57) aforesaid are resilient metal parts.

8. A sheath according to claim 6, wherein the angle (A) made between the resilient members (57) in the region of initial divergence of said members is smaller than the angle (B) made between the blade-sharpening profiles at their point (P) of intersection.

9. A combination of a blade-sharpening sheath according to claim 1 with a knife (46) provided with a handle (47) and a blade (48) having a cutting edge (51) and a back (49) opposite to said cutting edge, wherein the sheath (1) is provided internally with a supporting slide-surface (43*a*) for the back of the knife blade (48), wherein at least a portion (L) of the back of the blade is substantially rectilinear and capable of sliding over the supporting slide-surface (43*a*), and wherein the distance (h) between a tip (52) of the blade (48) and the extension of the rectilinear portion (L) of the back (49) is equal to or slightly shorter than the distance (H) between the supporting surface (43*a*) and the bottom of the blade-sharpening cavity (P) when the blade-sharpening elements (31) are in the rest position.

10. A combination according to claim 9, wherein the rectilinear portion (L) of the back (49) extends to the vicinity of the blade tip (52) and is joined to said tip by means of an end portion (53) which extends in a transverse direction of the blade (48).

11. A combination according to claim 9 wherein, with respect to the substantially rectilinear portion (L) of the back (49) of the blade (48), the cutting edge (51) of the blade is oblique in the direction which converges to the tip (52) of the blade (48) substantially over the entire length of said blade.

* * * * *